United States Patent [19]

Koivumäki et al.

[11] 4,430,694

[45] Feb. 7, 1984

[54] ARRANGEMENT FOR MOUNTING LIGHTING FIXTURES

[75] Inventors: Harri Koivumäki; Jouko Sinkkonen, both of Iittala, Finland

[73] Assignee: A. Ahlstrom Osakeyhtio, Noormarkku, Finland

[21] Appl. No.: 326,616

[22] Filed: Dec. 2, 1981

[51] Int. Cl.[3] ..... F21V 21/14

[52] U.S. Cl. ..... 362/250; 362/285; 362/382; 362/391; 362/404; 362/407

[58] Field of Search ..... 362/391, 250, 285, 382, 362/404, 407, 418

[56] References Cited

U.S. PATENT DOCUMENTS

| | | | |
|---|---|---|---|
| 249,449 | 11/1881 | Behn | 362/391 |
| 329,510 | 11/1885 | Travis | 362/391 |
| 2,858,381 | 10/1958 | Goldberg et al. | 362/407 X |
| 3,409,262 | 11/1968 | Soule | 362/225 X |
| 3,524,050 | 8/1970 | Gustine | 362/219 |
| 4,130,858 | 12/1978 | Hayakawa | 362/150 |

*Primary Examiner*—Stephen J. Lechert, Jr.
*Attorney, Agent, or Firm*—Bucknam and Archer

[57] ABSTRACT

An arrangement for mounting lighting fixtures is provided. The lighting fixture or a plurality of lighting fixtures in a row are mounted on carriages movably disposed on a horizontal rail. The lighting fixtures can be moved from an operating position to a maintenance position by means of a first rope connected to the utmost carriages, whereby the movement of the utmost carriage to the maintenance position will push the carriages in front of it with regard to the direction of movement to a position in which all carriages are positioned close to each other. The lighting fixtures can be moved from a maintenance position to an operating position by means of a second rope being connected to each of the carriages, whereby movement of the utmost carriage to the operating position by means of the first rope will pull the carriages behind it with regard to the direction of movement to a position in which all carriages are positioned a distance apart from each other.

3 Claims, 4 Drawing Figures

ARRANGEMENT FOR MOUNTING LIGHTING FIXTURES

The present invention relates to an arrangement for mounting lighting fixtures, in particular meant for use in an industrial environment containing dust.

It is an object of the present invention to provide an arrangement which facilitates the maintenance and cleaning of the lighting fixtures.

According to the invention the lighting fixture is mounted on a carriage which is movably disposed on a horizontal rail and connected to means for transferring the lighting fixture from the position where it normally operates to a position where it can be maintained.

Lighting fixtures in industrial buildings are usually mounted above manufacturing machines or in other places that are difficult to access. In order to maintain them, cranes or other lifting means are needed. Lighting fixtures which are connected to a wire rope by means of which they can be taken down for maintenance are known, but this does not provide an acceptable arrangement if the lighting fixture is disposed above a manufacturing machine which is in operation.

By means of the invention the lighting fixtures can be transferred to a position, in which the maintenance can easily and in accordance with the safety regulations be effected without any need of cranes. The installation of the lighting fixtures is also very favourable from the viewpoint of economy.

A preferred embodiment of the invention is described below in more detail with reference to the enclosed drawings in which.

Figure 1:
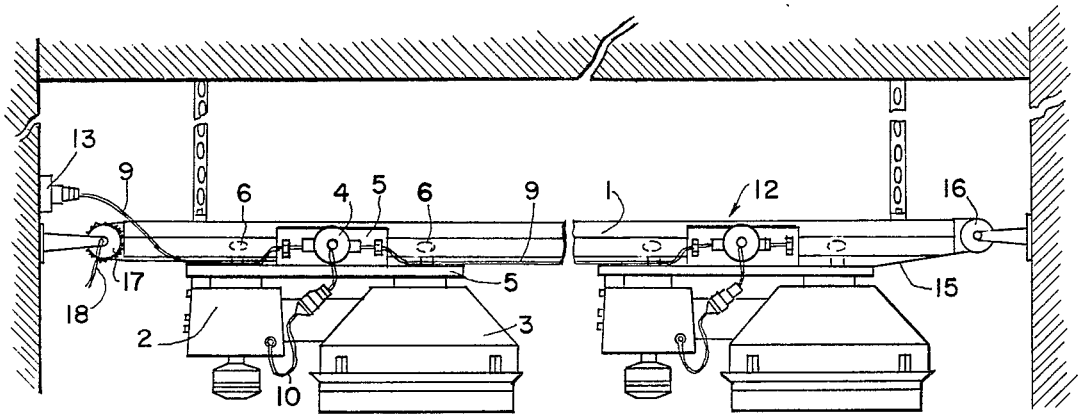
FIG. 1 shows a side view of an arrangement comprising two lighting fixtures in their operating positions.

In the figures, reference number 1 refers to a horizontal rail suspended from the ceiling of the building. A lighting fixture comprising a ballast assembly 2, an optical assembly 3 and a distributing assembly box 4 is mounted on a frame 5 to which to sets of wheels 6 are attached. The frame and the wheels form a carriage for the lighting fixture. The wheels 6 are disposed in a channel 7 of the rail 1 forming two flanges 8 along which the wheels can move guided by the side walls of the channel.

A plurality of lighting fixtures can be mounted on the same rail, two of which are shown on the drawings. The distributing boxes of the lighting fixtures are electrically connected to each other and to the supply voltage by supply leads 9. A ballast lead 10 connects the ballast assembly to the distributor box. A wire rope 11 or the equivalent, running along the supply leads from the utmost carriage 12 to a terminal box 13 disposed on the wall of the building, is fastened to the frame of the carriages by clamps 14. Another wire rope 15 or the equivalent, connected to carriage 12 only runs as an endless loop from drum 16 to a drum 17.

Figure 2:
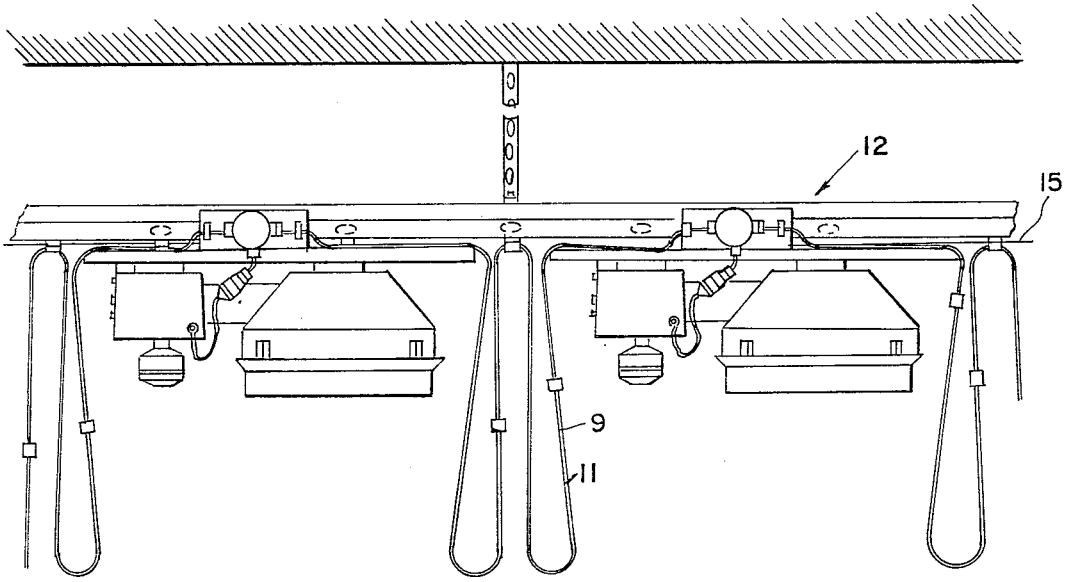
FIG. 2 shows a side view of the lighting fixtures in their maintenance position.
Figure 3:
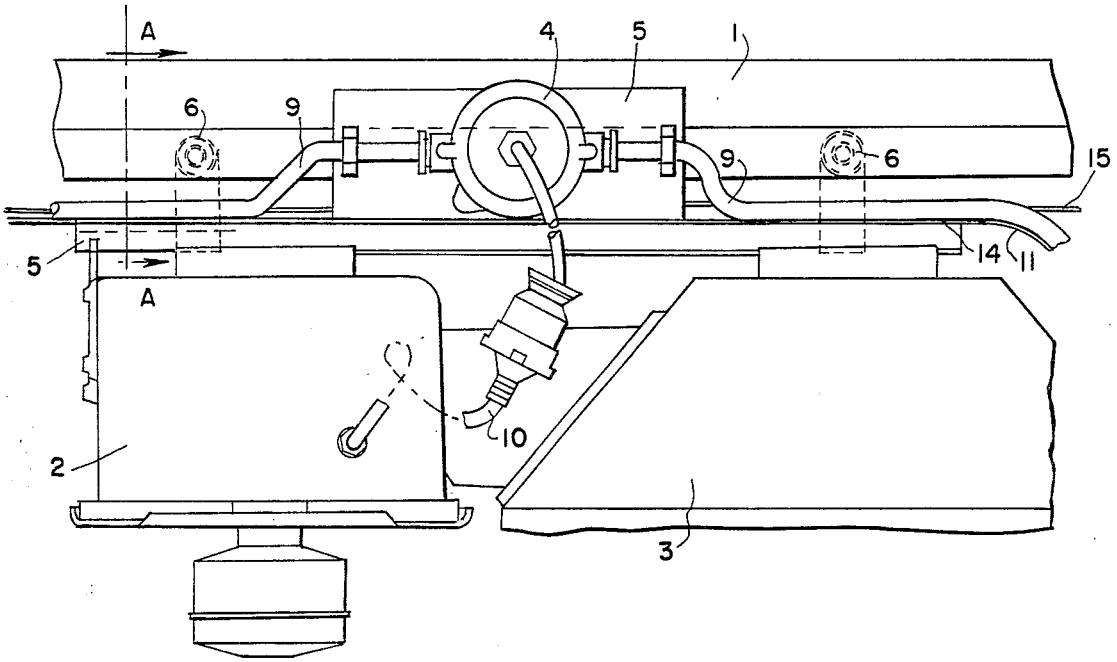
FIG. 3 shows an enlarged side view of the lighting fixture shown in FIG. 1.
Figure 4:
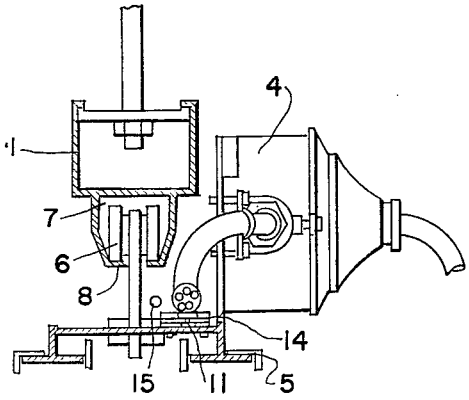
FIG. 4 shows a cross-sectional view taken along line A—A of FIG. 3.

When the lighting fixtures are to be moved to their maintenance position close to each other, shown in FIG. 2, the drum 17 is rotated clockwise by means of a crank 18, whereby the wire rope 15 attached to the carriage 12 moves it to the left. When carriage 12 has reached the carriage directly in front of it, the former will begin to push the latter and successively cause all the carriages in front of it to move in the same direction. The movement of the carriages is controlled until their maintenance position is reached.

After maintenance, the carriages are returned to their operating position a distance apart from each other, shown in FIG. 1, by rotating the drum 17 in the opposite direction, whereby the wire connected to the last carriage 12 will move it to the right, and will successively begin to pull all the carriages interconnected by the wire rope 11 to move in the same direction, until they are restored into their initial position.

The arrangement can be used, principally in the same way, for a single lighting fixture. The drum 17 can be driven by a motor.

What is claimed is:

1. An arrangement for mounting a plurality of lighting fixtures in a row, comprising a horizontal rail; a plurality of carriages supported by said rail for movement therealong, said lighting fixtures each being connected to a corresponding carriage for movement therewith along said rail; each of said carriages having a plurality of wheels that engage said horizontal rail to accomodate movement of the carriage therealong; a rope drive means connected with each of said carriages and operable to move same along said rail between respective operating positions in which the carriages are spaced apart by a given distance and servicing positions in which the carriages are spaced apart by a lesser distance; said rope drive means including a first, endless rope, running between oppositely disposed drums, one of said drums having associated driving means, said first rope being connected to an endmost one of said carriages, and a second rope connected to each of said carriages and establishing the positions of said carriages along the rail when said endmost carriage is moved to its operating position.

2. An arrangement according to claim 1 including a ballast assembly connected to each of said carriages for movement therewith and electrically connected to the lighting fixture carried by such carriage for the operation of said lighting fixture.

3. An arrangement according to claim 1 including electrical lines running between each pair of adjacent carriages and connected to said second rope to run said electrical lines in unison therewith.

* * * * *